US009487374B2

(12) United States Patent
Decker

(10) Patent No.: US 9,487,374 B2
(45) Date of Patent: Nov. 8, 2016

(54) AUTOMATIC ANNULAR WINDING MACHINE

(76) Inventor: Desmond Decker, Zhongshan (CN)

( * ) Notice: Subject to any disclaimer, the term of this patent is extended or adjusted under 35 U.S.C. 154(b) by 366 days.

(21) Appl. No.: 12/668,001

(22) PCT Filed: Aug. 28, 2008

(86) PCT No.: PCT/CN2008/001546

§ 371 (c)(1),
(2), (4) Date: Jan. 6, 2010

(87) PCT Pub. No.: WO2009/086718

PCT Pub. Date: Jul. 16, 2009

(65) Prior Publication Data

US 2010/0181413 A1 Jul. 22, 2010

(30) Foreign Application Priority Data

Jan. 10, 2008 (CN) ..... 2008 1 0000395

(51) Int. Cl.
*B65H 81/02* (2006.01)
*B65H 54/22* (2006.01)

(52) U.S. Cl.
CPC ..... *B65H 54/22* (2013.01)

(58) Field of Classification Search
USPC ..... 242/431, 434, 434.5, 434.6, 434.7
See application file for complete search history.

(56) References Cited

U.S. PATENT DOCUMENTS

| | | | | |
|---|---|---|---|---|
| 3,702,499 | A * | 11/1972 | Virsbreg | 29/605 |
| 3,766,641 | A * | 10/1973 | Metzler et al. | 29/605 |
| 4,730,777 | A | 3/1988 | Graul et al. | |
| 2004/0108401 | A1* | 6/2004 | Muller et al. | 242/434 |
| 2005/0247815 | A1* | 11/2005 | Sweeney et al. | 242/434 |
| 2006/0290227 | A1* | 12/2006 | Cho | 310/194 |

FOREIGN PATENT DOCUMENTS

| | | |
|---|---|---|
| CN | 86100947 | 11/1986 |
| CN | 2439092 | 7/2001 |
| JP | 4-330704 | 11/1992 |

* cited by examiner

*Primary Examiner* — Emmanuel M Marcelo
(74) *Attorney, Agent, or Firm* — Knobbe, Martens, Olson & Bear, LLP

(57) ABSTRACT

An automatic annular winding machine includes a paying off unit, a sending wire group, a winding wire group, a sending material group, and a perpendicularly vibrating hopper. The wires are sent to the winding wire group by the sending wire group. A magnetic ring is put into the perpendicularly vibrating hopper and sent to a clamping holder by the sending material group. Then the wires are winded on the magnetic ring by a lead pin of the winding wire group. The winding wire group further includes a pull wire slanting wheel group comprising of a pull wire slanting wheel, a spring, and a regulatable suspending sliding block. Accordingly, the heads of the plurality twisted wires would not branch off during working, and the length of the heads is left after winding accomplishing.

8 Claims, 3 Drawing Sheets

AUTOMATIC ANNULAR WINDING MACHINE

BACKGROUND OF THE INVENTION

1. Field of the Invention

The present invention relates to an equipment used to wind wires onto an annular body, and in particular to a winding machine that is used to guide and wind a plurality of wires fully automatically onto a magnetic ring.

2. The Prior Arts

In general, the winding machine presently on market includes: a paying off unit, a seeding wire group, a winding wire group, a sending material group, and a hopper. Wherein, lacquered wire is sent by the seeding wire group from the paying off unit to the winding wire group, a magnetic ring is put into the hopper and is sent by the sending material group into a winding operation position, then the two pairs of slanting wheel groups and a winding pin of the a winding wire group are used to wind the lacquered wire onto a magnetic ring. Usually, this kind of winding machine is able to wind a single lacquered wire onto a magnetic bar or magnetic ring, and its operation principle is that wires are guided by two pairs of slanting wheel groups and a winding pin to make circular motion in a circular ring, such that wires are winded on magnetic ring in circles. However, for a plurality of twisted wires formed by twisting two or more than two lacquered wires, since in guiding wires by the winding wire group and a winding pin, the heads of the plurality of twisted wires tends to branch off, thus this is disadvantageous for winding wires continuously and automatically on different magnetic rings, and for a magnetic ring of smaller diameter, the winding operation can not even be performed continuously. On the other hand, upon completing winding wires on a magnetic ring, the length of wire head left is fixed after the wire is cut off by an existing winding machine, and that is difficult for adding other related components to the head of wire. Therefore, the performance of the existing winding machine is not quite satisfactory.

SUMMARY OF THE INVENTION

In view of the problems and shortcomings of the existing winding machine of the prior art, a major objective of the present invention is to provide an fully automatic annular winding machine, that is capable of winding continuously and fully automatically a plurality of twisted wires on different magnetic rings, such that the head of wire will not branch off, and the length of wire head left after completion of wire winding on a magnetic ring can be set.

In order to achieve the above mentioned objective, the present invention provides a fully automatic annular winding machine, including: a table; and a paying off unit, a seeding wire group, a winding wire group, a sending material group, and a perpendicularly vibrating hopper provided thereon; and inside the table are provided with a DC power source, mechanical arms, and electrical drivers. The sending wire group is driven by a servo electric driver in sending the wire from the paying off unit to a winding wire group. The magnetic ring is put into the perpendicularly vibrating hopper and is sent by the sending material group into a clamping holder. The clamping holder is used to make the magnetic ring to be located in a winding wire platter of the winding wire group, then, a wire-leading cylinder of the winding wire group will drive the lead pin in putting the wire into a hole of the magnetic ring, and also winding onto the magnetic ring. The winding wire group is further provided with a pull wire slanting wheel group, and pull wire slanting wheel group includes a pull wire slanting wheel, a spring, and a regulatable suspending sliding block. The pull wire slanting wheel is used to tighten the wire; the spring and the regulatable suspending sliding block are used to regulate the magnitude of clamping force exerted on the wire. A plurality of twisted wires made of two or more than two wires is made to run through the pull wire slanting wheel group, so that the wire heads of the plurality of twisted wires will not branch off in the winding operation. The winding wire group is able to wind the plurality of twisted wires onto different positions of the magnetic ring, such that the plurality of twisted wires on the magnetic ring will not overlap each other, as such the plurality of twisted wires can be winded separately onto different magnetic rings continuously, in realizing the fully automatic winding of wires.

As to an aspect of the present invention, the table is provided with a man-machine interface thereon, that can be utilized to set the length of wire head left after completion of wire winding on a magnetic ring through utilizing a programmable controller and a servo electric driver.

As to another aspect of the present invention, the table is provided with an infra-red optical fiber sensor thereon, such that the man-machine interface is able to set the number of turns of wires winded around the magnetic ring by making use of the programmable controller and the infra-red optical fiber sensor, thus ensuring the accuracy of he number of turns of wires winded around the magnetic ring, and avoiding duplicate windings of wires.

As to a further aspect of the present invention, the infra-red optical fiber sensor provided on the table is located in the middle position between a pull wire slanting wheel group and a magnetic ring, such that when the wire is tightened, the magnetic ring will rotate at the same time, so as to avoid that the wires overlap each other on the magnetic ring.

As to still another aspect of the present invention, the pull wire slanting wheel group includes two pairs of slanting wheels, that are located correspondingly relative to a winding wire platter of a winding wire group.

As to another aspect of the present invention, the mechanical arms are composed of a longitudinal transport mechanical arm and a horizontal transport mechanical arm. The mechanical arms are used to pull the magnetic ring having wires winded thereon from the operation position and deliver it to a designated position.

As to a still further aspect of the present invention, the DC power source is used to provide power to the man-machine interface, the programmable controller, and step electrical driver.

As to still another aspect of the present invention, the electrical driver includes a servo electrical driver and a step electrical driver.

Summing up, the advantages of the a fully automatic annular winding machine of the present invention are as follows.

(1) From the structure mentioned above it can be known that, when the plurality of twisted wires passing through the pull wire slanting wheel group of the winding wire group, they will actuate a spring and a regulatable suspending sliding block into action, and that will make the clamping force of the wire proper, thus the wire head of the winded wire will not branch off, so that the plurality of twisted wires can be winded separately on different magnetic rings continuously.

(2) In the present invention, knife is not provided at the end of the wire pulling portion of the winding machine, such that the end of the wire will not be cut after the completion of wire-winding, instead, the end of the wire is pulled out directly by a mechanical arm, hereby ensuring a certain length of wire head to be left, therefore the man-machine interface is capable of setting a certain length of wire head to be left after the completion of wire-winding on the magnetic ring through utilizing a programmable controller and a servo electrical driver, thus facilitating adjustment of the length of wire head depending on the requirements of various products; and (3) The man-machine interface can be used to control the number of turns of wire winded around the magnetic ring by making use of the programmable controller and the infra-red optical fiber sensor, thus ensuring the accurate and easy adjustment of the pitch between wires on the magnetic ring, and avoiding duplicate windings of wires.

The fully automatic annular winding machine of the present invention is especially suitable for the use in the occasions that the outer diameter of the magnetic ring is small, the plurality of twisted wires are thin, and manual operation is difficult, thus raising the efficiency of production and quality of product, and having the advantages of easy control and stable operation.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
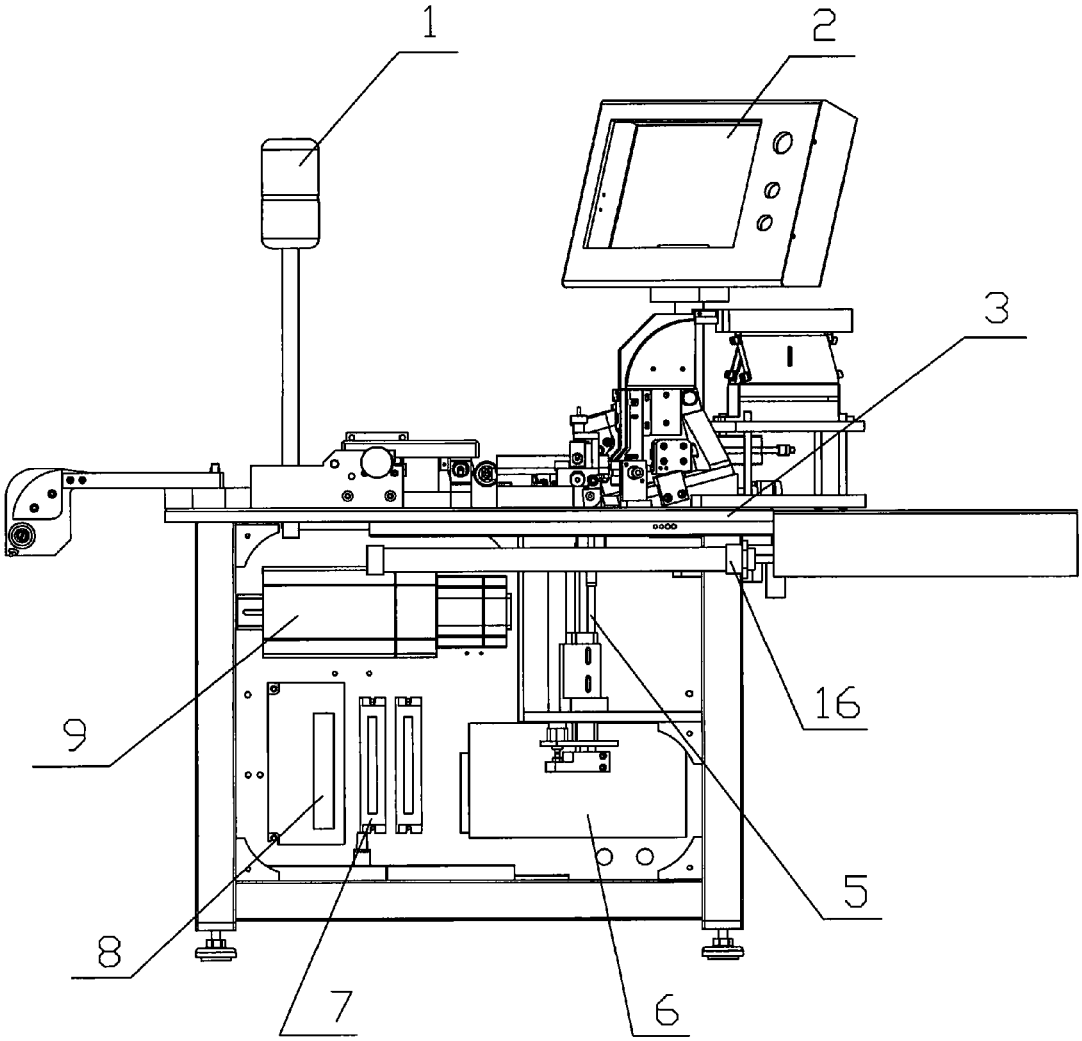
FIG. 1 is a schematic diagram of a front view of a fully automatic annular winding machine according to the present invention.
Figure 2:
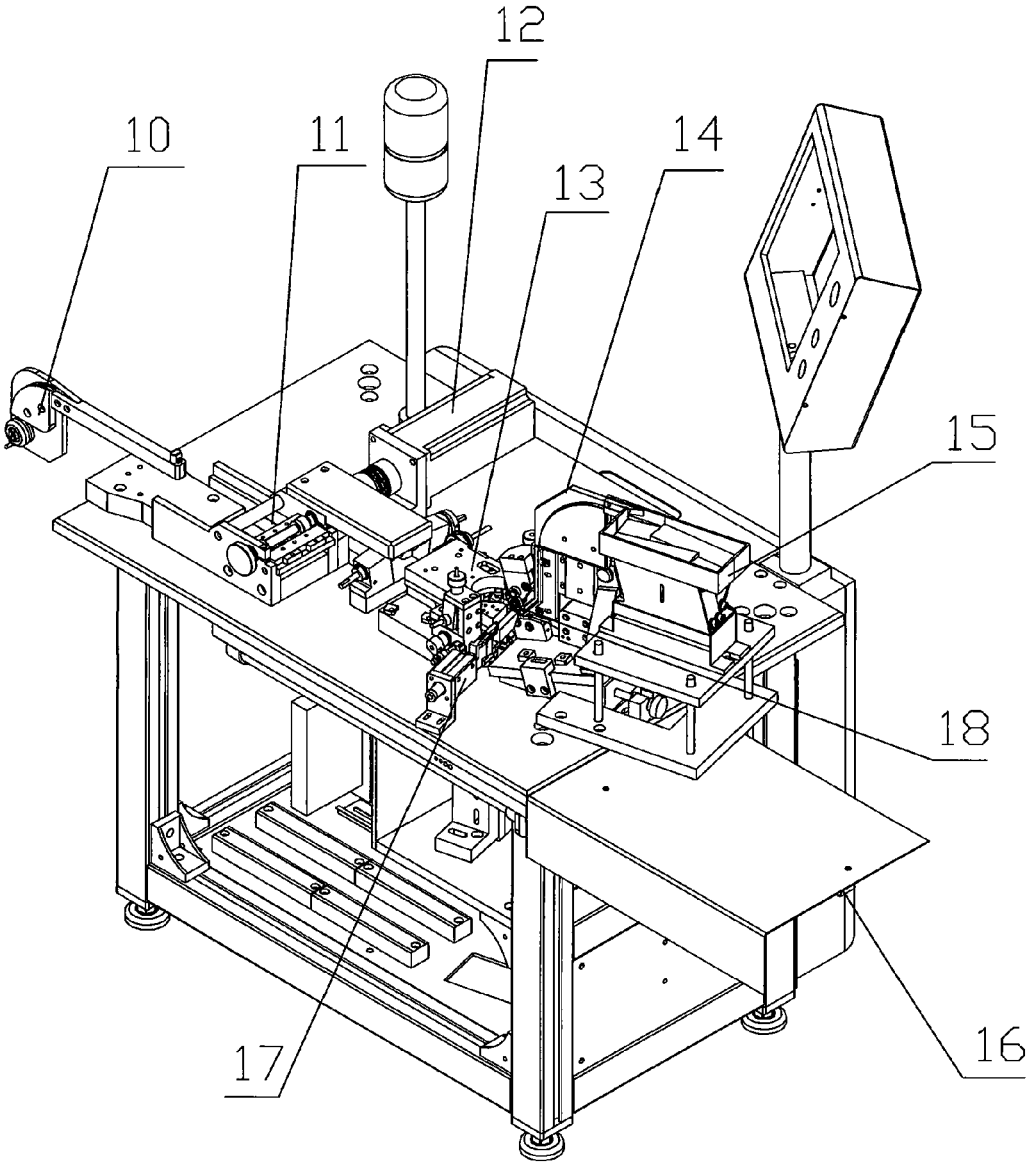
FIG. 2 is a schematic diagram of a perspective view of a fully automatic annular winding machine according to the present invention.
Figure 3:
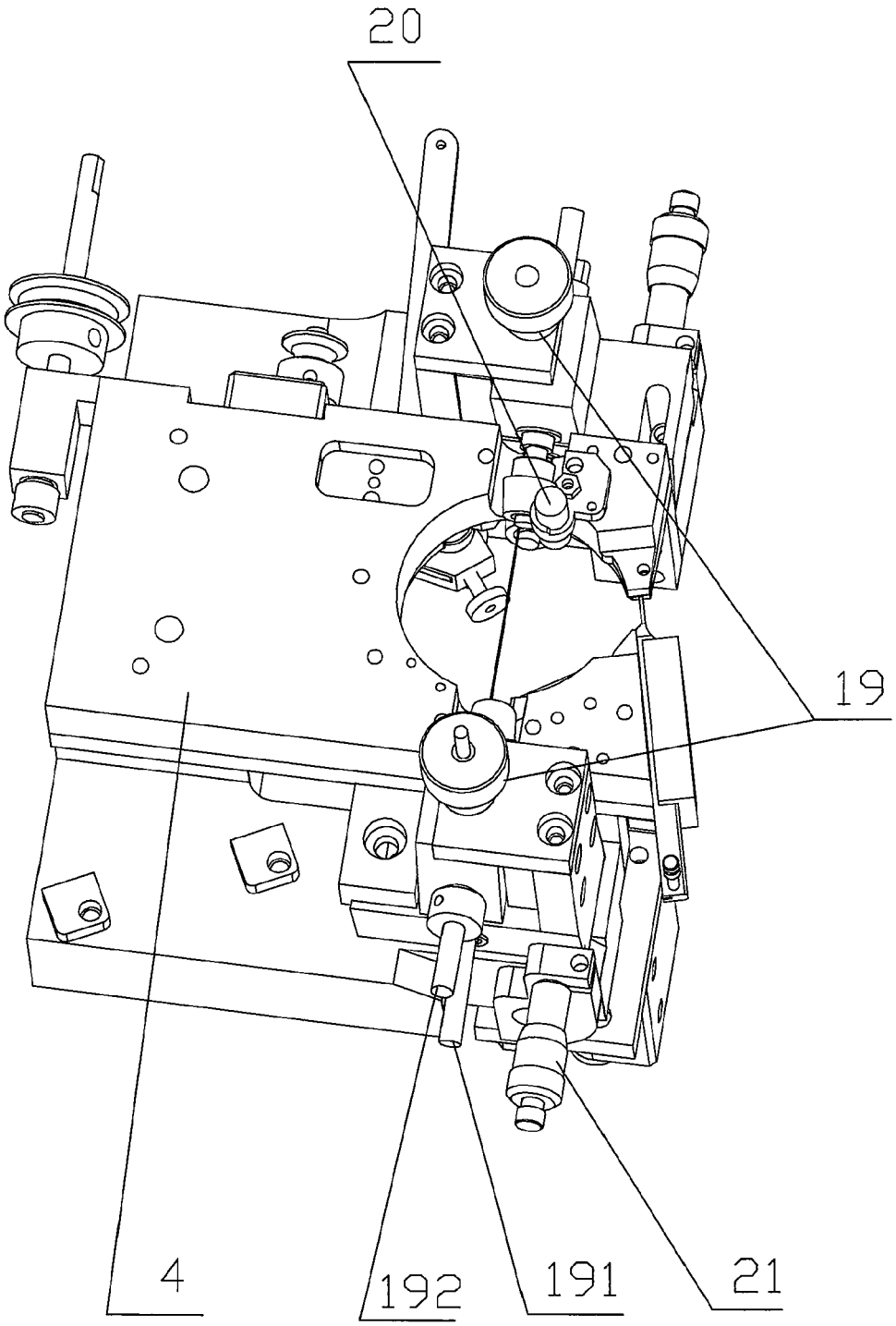
FIG. 3 is a schematic diagram of a partial view of upper portion members on a table according to the present invention.

Firstly, referring to FIGS. 1 to 3 for a front view, perspective view, and a partial view of a fully automatic annular winding machine according to the present invention. As shown in FIG. 1, the fully automatic annular winding machine of the present invention includes: a table 3; and a paying off unit 10, a seeding wire group 11, a winding wire group 13, a sending material group 14, and a perpendicularly vibrating hopper 15 provided thereon. Inside the table 3 are provided with DC power source 6, mechanical arms, and electrical drivers. An indication lamp 1 is provided on the table 3. A sending wire group 11 is driven by a servo electrical driver 12 in driving a plurality of twisted wires from a paying off unit 10 to a winding wire group 13, a magnetic ring is put into a perpendicularly vibrating hopper 15 and is sent to the clamping holder 18 by the sending material group 14. The clamping holder 18 is provided, so that the magnetic ring is located in a winding wire platter 4 of winding wire group 13. The winding wire group 13 further includes a pull wire slanting wheel group 19 consisting of two pairs of plastic slanting wheels, a spring, a regulatable suspending sliding block, an upper slanting wheel axis 192, and a lower slanting wheel axis 191. The two pairs of plastic slanting wheels are located respectively at corresponding positions relative to the winding wire platter 4 of winding wire group 13. A micro-adjustable micrometer head 21 is used to regulate the forward and backward positions of a pull wire slanting wheel group 19, so that the rotation speeds of the two pairs of plastic slanting wheels will match each other. The plurality of twisted wires are able to rotate in the winding wire platter 4. The pull wire slanting wheel group 19 is used to pull the plurality of twisted wires tight, such that when the ends at one side of the plurality of twisted wires are pulled tight, the plurality of twisted wires can be pulled out from the winding wire platter 4, and then a lead pin is driven by a wire-leading cylinder 17 of the winding wire group 13 to put the plurality of twisted wires into a hole of the magnetic ring, so that the winding wire platter 4 becomes a closed platter. As such, the pull wire slanting wheel group 19 brings the plurality of twisted wires to move in the magnetic ring, such that the plurality of twisted wires are pulled out from the slanting wheel and are winded onto the magnetic ring and are pulled tight.

Regulating the a spring and a regulatable suspending sliding block of a pull wire slanting wheel group 19, such that it will exert an appropriate clamping force on the plurality of twisted wires. When the plurality of twisted wires run through the pull wire slanting wheel group 19, it will actuate the spring and the regulatable suspending sliding block into action, such that the wire heads of the plurality of twisted wires will not breach off in operation. The winding wire group 13 is able to wind the plurality of twisted wires onto different positions of the magnetic ring, so that the plurality of twisted wires will not overlap with each other on the magnetic ring, and they can further be winded separately onto different magnetic ring continuously, hereby realizing fully automatic wire winding.

In the present embodiment, a man-machine interface 2 is provided on a table 3, thus the man-machine interface 2 is able to set the length of wire head left after finishing wire winding of a magnetic ring through utilizing a programmable controller 9 and a servo electrical driver 12, and a wire cutting blade will cut the wire coming from the wire axis at preset length. Furthermore, table 3 is provided with an infra-red optical fiber sensor 20 thereon, the infra-red optical fiber sensor 20 is located in a middle position between the pull wire slanting wheel group 19 and the magnetic ring, thus ensuring the clamping holder 18 will rotate, when plurality of twisted wires on the magnetic ring are pulled tight, such that the possibility of the plurality of twisted wires overlapping each other on the magnetic ring is significantly reduced. Moreover, the man-machine interface 2 is able to set the number of turns of plurality of twisted wires winded around the magnetic ring by making use of the programmable controller 9 and infra-red optical fiber sensor 20, thus ensuring the accuracy of the number of turns of the plurality of twisted wires winded around the magnetic ring, and avoiding duplicate windings of wires.

In the present embodiment, mechanical arms are composed of a longitudinal transport mechanical arm 5 and a horizontal transport mechanical arm 16. The mechanical arms 5 and 16 are used to pull the magnetic ring having wires winded thereon from the operation position and deliver it to a designated position. A DC power source 6 is used to provide power to the man-machine interface 2, a programmable controller 9, and a step electrical driver. The electrical driver includes a servo electrical driver 8 and a step electrical driver 7.

Summing up the above and in conclusion, the operation flow of a fully automatic annular winding machine of the present invention can be summarized as follows:

(a) firstly, a magnetic ring is sent from a perpendicularly vibrating hopper 15 to a sending material group 14, then the magnetic ring is sent by the sending material group 14 into a winding wire platter 4, at this time the wire head is made to pass through the center of a magnetic ring to form a closed winding wire platter 4;

(b) next, a thin and hollow tube is provided between a sending wire group 11 and the winding wire platter 4, thus wire is sent to the wire-cutting end of the winding wire platter 4 through the thin tube. As such, when the above step (a) is completed, the sending wire group 11 starts to work, and sends the wire from the wire-cutting end to winding wire platter 4, and inside the winding wire platter 4, the pull wire slanting wheel group brings the wire into motion inside the entire winding wire platter, and upon reaching the wire storage length as required, then the sending wire group 11 stops operation; and (c) finally, the plurality of twisted wires are pulled and moved out from the pull wire slanting wheel group 19, and is winded around the magnetic ring. An infra-red optical fiber sensor is used to detect the number of turns of the plurality of twisted wires, and for each turn of the wire will make the clamping holder 18 of the magnetic ring rotate once, such that the wire will distribute evenly on the magnetic ring. Upon finishing wire winding on the magnetic ring, the wire exit door on the winding wire platter 4 will open to exit the wire, and upon completing the above mentioned steps, the mechanical arms 5 and 16 will fetch the magnetic ring out of the clamping holder 18. Meanwhile, the sending wire group 11 will start to work again and send out a predetermined length of wire, and the mechanical arms 5 and 16 will take out the magnetic ring having the wire winded thereon.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A fully automatic annular winding machine, comprising:

a table, and a paying off unit, a seeding wire group, a winding wire group, a sending material group, and a perpendicularly vibrating hopper provided thereon; and inside said table are provided with a DC power source, mechanical arms, and electrical drivers, said sending wire group is driven by a servo electric driver in sending a wire from said paying off unit to said winding wire group; a magnetic ring is put into said perpendicularly vibrating hopper and is sent by said sending material group into a clamping holder; said clamping holder is used to make said magnetic ring to be located in a winding wire platter of said winding wire group, then, a wire-leading cylinder of said winding wire group will drive a lead pin in putting said wire into a hole of said magnetic ring, and also winding onto said magnetic ring, and it is characterized in that:

said winding wire group is further provided with a pull wire slanting wheel group, and said pull wire slanting wheel group includes a pull wire slanting wheel, a spring, and a regulatable suspending sliding block, said pull wire slanting wheel is used to tighten said wire; said spring and said regulatable suspending sliding block are used to adjust magnitude of clamping force exerted on said wire; a plurality of twisted wires made of two or more than two wires run through said pull wire slanting wheel group, so that wire heads of said plurality of twisted wires will not branch off in the winding operation, said winding wire group is able to wind said plurality of twisted wires onto different positions of said magnetic ring, such that said plurality of twisted wires will not overlap each other on said magnetic ring, as such said plurality of twisted wires can be winded separately onto different magnetic rings continuously, in realizing a fully automatic winding of wires.

2. The fully automatic annular winding machine as claimed in claim 1, wherein said table is provided with a man-machine interface thereon, that can be utilized to set lengths of wire heads left after completion of wire winding on said magnetic ring through utilizing a programmable controller and said servo electric driver.

3. The fully automatic annular winding machine as claimed in claim 1, wherein the table is provided with an infra-red optical fiber sensor thereon, such that the man-machine interface is able to set number of turns of said wires winded around said magnetic ring by making use of said programmable controller and an infra-red optical fiber sensor, thus avoiding duplicate windings of said wires.

4. The fully automatic annular winding machine as claimed in claim 3, wherein infra-red optical fiber sensor is located in a middle position between said pull wire slanting wheel group and said magnetic ring.

5. The fully automatic annular winding machine as claimed in claim 1, wherein said pull wire slanting wheel group includes two pairs of slanting wheels, that are located correspondingly to each other relative to said winding wire platter of said winding wire group.

6. The fully automatic annular winding machine as claimed in claim 1, wherein said mechanical arms are composed of a longitudinal transport mechanical arm and a horizontal transport mechanical arm.

7. The fully automatic annular winding machine as claimed in claim 1, wherein said DC power source is used to provide power to said man-machine interface, said programmable controller, and a step electrical driver.

8. The fully automatic annular winding machine as claimed in claim 1, wherein said electrical driver includes said servo electrical driver and said step electrical driver.

* * * * *